US005398013A

United States Patent [19]

Suzuki et al.

[11] Patent Number: 5,398,013

[45] Date of Patent: Mar. 14, 1995

[54] ACTUATOR FOR ROTATING A ROTARY MEMBER

[75] Inventors: Katsumi Suzuki, Anjo; Hideya Hori, Okazaki; Mamoru Nakamura, Kariya, all of Japan

[73] Assignee: Aisin Seiki Kabushiki Kaisha, Kariya, Japan

[21] Appl. No.: 277,569

[22] Filed: Jul. 20, 1994

[30] Foreign Application Priority Data

Jul. 23, 1993 [JP] Japan ..... 5-183034

[51] Int. Cl.[6] ..... H01F 7/08; H01F 7/14

[52] U.S. Cl. ..... 335/272; 335/265

[58] Field of Search ..... 335/73, 110, 114, 125, 335/190, 191, 228, 232, 265, 267, 272, 276

[56] References Cited

FOREIGN PATENT DOCUMENTS 63-173554 11/1988 Japan .

*Primary Examiner*—Leo P. Picard
*Assistant Examiner*—Raymond M. Barrera
*Attorney, Agent, or Firm*—Burns, Doane, Swecker & Mathis

[57] ABSTRACT

The invention is directed to an actuator which is mounted on a base to rotate a rotary member about a rotational axis thereof. The actuator includes a first magnetic rotary member which is rotatably mounted on the base about the axis, and provided with a first engaging portion which traces a peripheral locus about the axis. It also includes a second magnetic rotary member which is rotatably mounted about the axis, and provided with a second engaging portion engageable with the first engaging portion on the peripheral locus about the axis. The first engaging portion is moved to be engageable with the second engaging portion when the first rotary member is rotated in one direction relative to the second rotary member, and the first engaging portion is moved to be away from the second engaging portion when the first rotary member is rotated in the opposite direction. A solenoid is concentrically mounted about the axis in stationary relationship with the base, and adapted for exciting the first and second rotary members to form a magnetic path therewith when the first and second engaging portions engage with each other. And, a rotating device such as a motor is provided for rotating the first rotary member about the axis.

11 Claims, 3 Drawing Sheets

ACTUATOR FOR ROTATING A ROTARY MEMBER

BACKGROUND OF THE INVENTION

1. Field of the Invention

The present invention relates generally to an actuator for rotating a rotary member about a rotational axis thereof, and in particular, to an actuator especially suited for actuating a throttle valve of an automotive vehicle to provide a cruise control operation for driving the vehicle at a constant speed.

2. Description of the Prior Art

Various actuators are known and have been used in automotive vehicles for actuating the throttle valves. An example of a prior actuator can be found in Japanese Utility-model Laid-open publication No. 63-173554, which includes a mechanism for reducing the rotational speed of a motor. The actuator also includes an output rotary member which has a solenoid disposed at a position remote from a rotational axis of the motor, and a throttle cable disposed in the vicinity of the rotational axis to open and close a throttle valve. The actuator further includes an input gear member which has a magnetic member disposed at a position to be attracted to the solenoid, and which rotates in meshed relationship with the speed reducing mechanism. When the solenoid attracts the magnetic member, the rotation of the motor is transmitted to the speed reducing mechanism, the input gear member, and the output rotary member, then the opening angle of the throttle valve is controlled via the throttle cable.

However, according to the prior actuator as described above, the solenoid is rotated in accordance with the rotation of the motor, so that lead wires for supplying electric power to the solenoid are moved to follow the rotation of the solenoid. Therefore, if the lead wires are caught by something and prevented from moving along with the solenoid, they may be damaged. In order to avoid this, may be employed a conductor which is electrically connected to an electric source and which has such a configuration to conform to the rotational locus of the solenoid, and also a brush which slides on the conductor to be electrically connected to the solenoid. In this case, however, since the conductor and the brush move in sliding contact with each other, the durability and reliability are deteriorated. Furthermore, since the solenoid is rotated, larger space is needed and the actuator as a whole becomes bigger, comparing with the above-described prior actuator.

With respect to the solenoid-operated actuator as described above, sometimes it is difficult to disconnect the solenoid and magnetic member, even if the excitation of the solenoid is terminated after they were attracted by exciting the solenoid, because of the attracting force caused by the residual magnetism and small electric potential difference. This phenomenon is, of course, inappropriate for the actuator, because the input gear member and output rotary member can not be disconnected.

SUMMARY OF THE INVENTION

Accordingly, it is an object of the present invention to provide an actuator for enabling an input member and an output member rotate relative to each other without moving a solenoid which connects or disconnects the input member and the output member.

It is another object of the present invention to provide an actuator for effectively disconnecting the input member and the output member against the attracting force created by the residual magnetism and small electric potential difference.

In accomplishing these and other objects, an actuator is mounted on a base to rotate a rotary member about a rotational axis thereof. The actuator includes a first magnetic rotary member which is rotatably mounted on the base about the rotational axis, and which is provided with a first engaging portion which traces a peripheral locus about the rotational axis. It also includes a second magnetic rotary member which is rotatably mounted about the rotational axis, and provided with a second engaging portion which is engageable with the first engaging portion on the peripheral locus about the rotational axis. The first engaging portion is moved to be engageable with the second engaging portion when the first magnetic rotary member is rotated in one direction relative to the second magnetic rotary member, and the first engaging portion is moved to be away from the second engaging portion when the first magnetic rotary member is rotated in the opposite direction relative to the second magnetic rotary member. A solenoid is concentrically mounted about the rotational axis in stationary relationship with the base. The solenoid is adapted for exciting the first and second magnetic rotary members to form a magnetic path therewith when the first and second engaging portions engage with each other. And, a rotating device such as a motor is provided for rotating the first magnetic rotary member about the rotational axis.

The solenoid preferably includes a bobbin which defines therein a through hole, and a coil which is wound around the bobbin. The first magnetic rotary member may include a cylindrical body portion which is received in the through hole of the bobbin.

It is preferable to further include a rotating shaft which is secured to the second magnetic rotary member extending along the rotational axis. The cylindrical body portion may be provided with a central aperture which is defined in the cylindrical body portion along its longitudinal axis, and which receives the rotating shaft. The rotating device may include an output gear rotating around its axis, and the first magnetic rotary member may include a sector wheel which is meshed with the output gear of the rotating device.

It is preferable to further include at least a nonmagnetic member which is provided in the magnetic path. The first and second engaging portions may respectively be provided with a right angle portion whose end surface contacts with an end surface of the other right angle portion when the second engaging portion engages with the first engaging portion.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENTS

Figure 1:
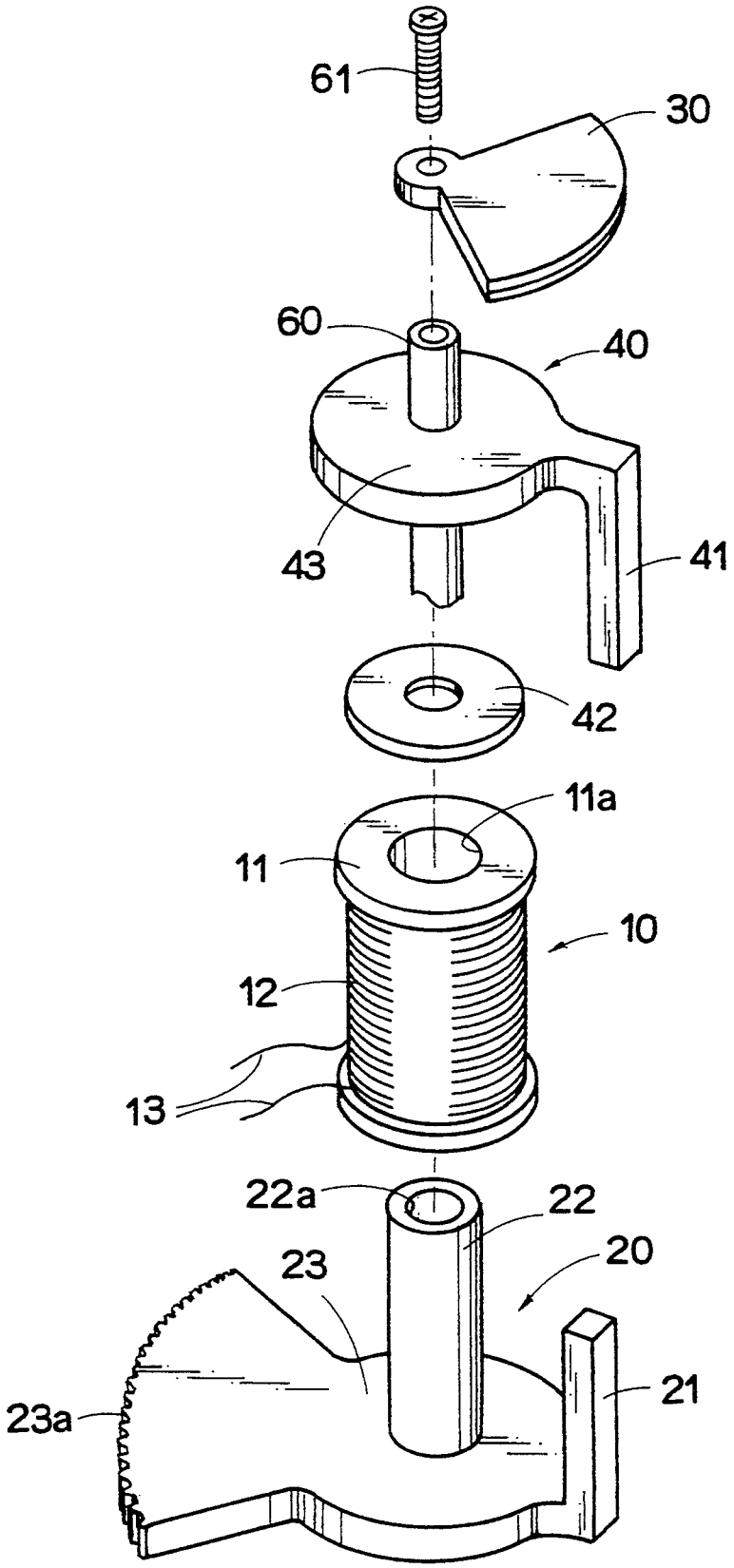
FIG. 1 is an exploded view of an actuator according to a first embodiment of the present invention.
Figure 2:
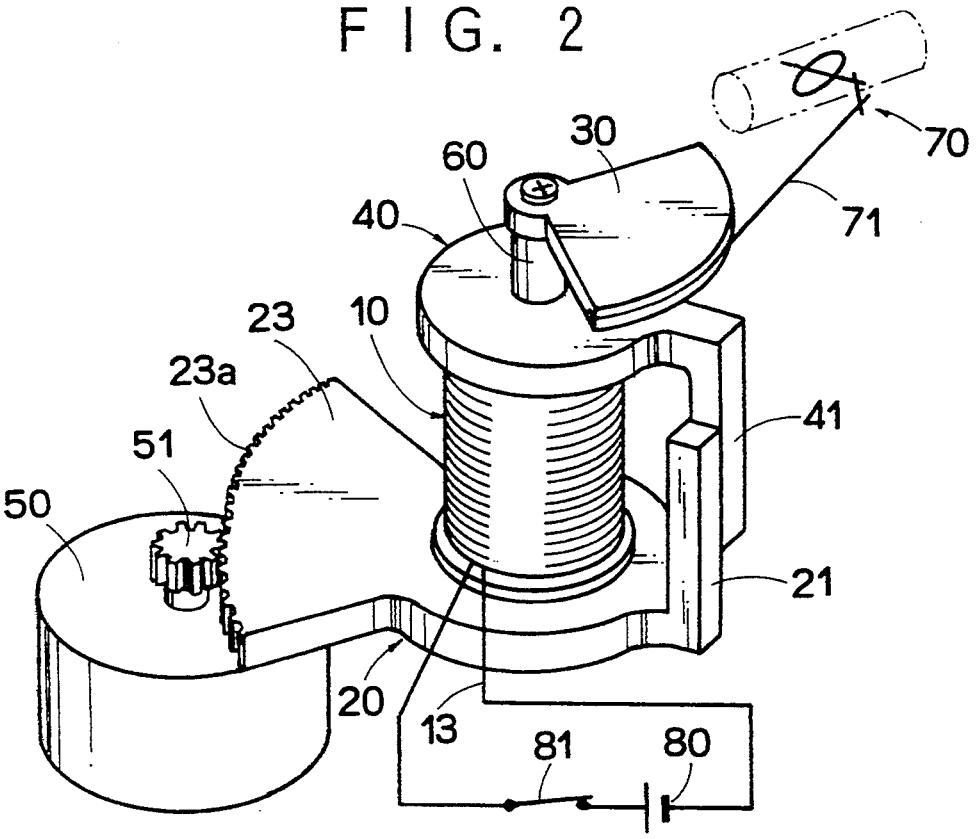
FIG. 2 is a perspective view of the actuator of the first embodiment when a solenoid is excited.
Figure 3:
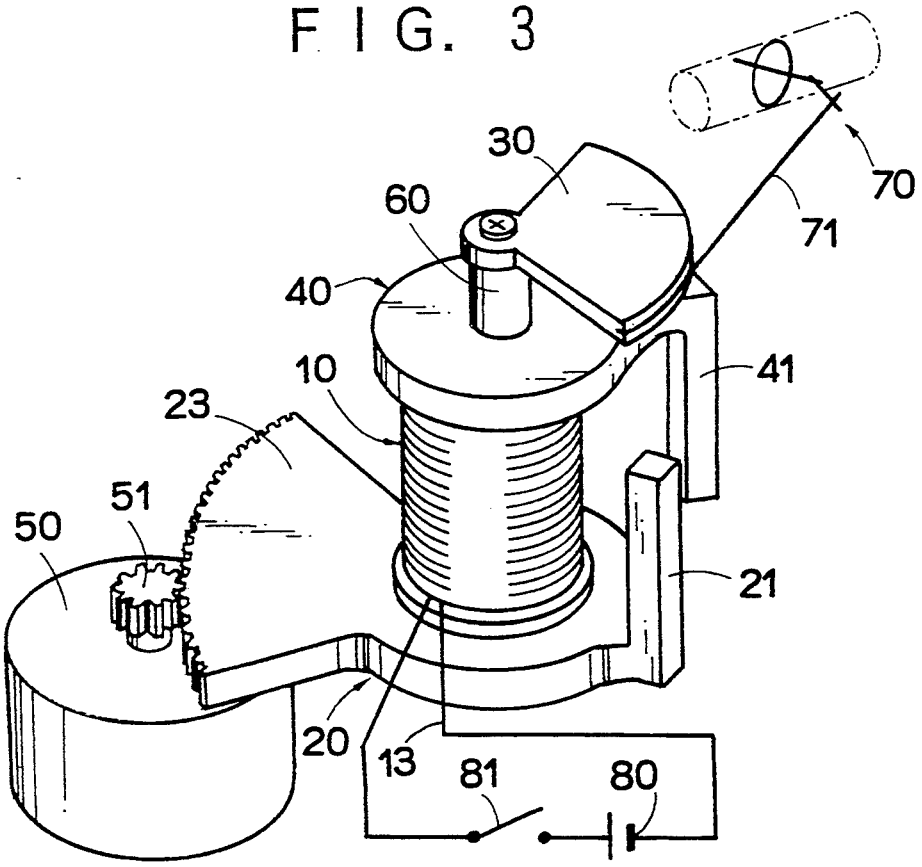
FIG. 3 is a perspective view of the actuator of the first embodiment when the solenoid is not excited.

Referring to the drawings, there is shown in FIGS. 1, 2 and 3, an actuator which is mounted on a vehicle (not shown) for actuating a throttle valve to provide a cruise control operation. The actuator includes a solenoid 10 and a first magnetic rotary member 20 which is rotatably mounted on a housing (not shown) about a longitudinal axis of the solenoid 10. The first rotary member 20 includes a plate 23 having a gear 23*a* formed on a peripheral surface of one end to form a sector wheel, and an engaging portion 21 which extends from the plate 23 perpendicularly to the planar surface thereof at a peripheral portion of the opposite end, and which defines a rectangular cross-section. On the plate 23, integrally formed is a cylindrical body portion 22, which extends from the plate 23 perpendicularly to the planar surface thereof, and which defines a central aperture 22*a* along a longitudinal axis perpendicular to the planar surface of the plate 23 for receiving a rotating shaft 60 of non-magnetic material which is described later. The solenoid 10 includes an insulating bobbin 11, which defines a through hole 11*a* therein along its longitudinal axis, and which defines an annular space for supporting a coil 12 in coaxial relationship about the through hole 11*a*. The coil 12 is connected to a pair of lead wires 13 which are connected to a battery 80 via a switch 81 as shown in FIGS.2 and 3.

In coaxial relationship with the solenoid 10 and the cylindrical body portion 22, a second magnetic rotary member 40 is mounted. The second rotary member 40 includes a plate 43 having an engaging portion 41 which defines a rectangular cross-section, and which extends from the plate 43 at a peripheral portion thereof perpendicularly to the planar surface of the plate 43 and in parallel with the engaging portion 21 of the first magnetic member to be engageable with each other when assembled and rotated. The rotating shaft 60 is arranged to penetrate the plate 43 perpendicularly thereto and secured to the plate 43 at its intermediate portion. One end portion of the shaft 60 (not shown in the drawings) is received, through a non-magnetic ring 42, in the central aperture 22*a* of the cylindrical body portion 22 to be positioned therein. The other end portion of the shaft 60 extends upward in FIGS. 1–3 to secure an output rotary member 30 forming a sector pulley at an arcuate angle portion thereof with a screw 61, in parallel spaced relationship with the plate 43.

In assembling the actuator, the cylindrical body portion 22 of the first rotary member 20 is received in the through hole 11*a* of the solenoid 10. After the non-magnetic plate 42 is placed on an end surface of the solenoid 10, the rotating shaft 60 is received in the central aperture 22*a* of the cylindrical body portion 22, and the end portion of the rotating shaft 60 is rotatably mounted on the first rotary member 20. Thus, the first rotary member 20 in the form of the sector wheel is connected to the second rotary member 40 rotatably about the rotating shaft 60, around which the solenoid 10 is provided between the first and second rotary members 20 and 40. In other words, the rotary members 20 and 40 are assembled to be rotatable about the solenoid 10 respectively, and the engaging members 21 and 41 are adapted to contact each other at their respective side surfaces.

Adjacent to the first rotary member 20 as shown in FIG. 2, there is provided a motor 50 so that a gear 51 which is mounted on an output shaft of the motor 50 can be meshed with the gear 23*a* of the sector wheel portion of the first rotary member 20. The output member 30 is connected to a throttle valve 70 via a throttle cable 71, and the throttle valve 70 is normally biased toward an idling position by a return spring (not shown). Accordingly, the throttle valve 70 is opened in response to the rotating force of the output member 30 which prevails against the biasing force of the return spring, while the throttle valve 70 is closed by the biasing force which prevails against the rotating force of the output member 30.

In the first embodiment of the present invention as described above, when the throttle valve 70 is controlled by means of the motor 50 to carry out the cruise control operation, the output member 30 is to be rotated in response to the rotation of the motor 50. For this purpose, the switch 81 is turned on by a controller (not shown) to supply a current to the coil 12, so that a magnetic path is formed between the first and second rotary members 20, 40 to make them attract each other as shown in FIG. 2. Therefore, the rotating force of the motor 50 can be transmitted to the second rotary member 40 through the first rotary member 20, and then to the output member 30 which rotates together with the second rotary member 40. The cruise control operation is to be terminated, when a brake pedal (not shown) is depressed, or when a cruise control switch (not shown) which is manually operated by a driver, is turned off, or when a vehicle speed exceeds a predetermined speed provided that the vehicle is running on a down hill. Thus, the switch 81 is turned off by the controller to stop supplying the current to the coil 12, so that the attracting force between the first and second rotary members 20, 40 is weakened to cancel the cruise control operation. However, a part of the attracting force between the first and second rotary members 20, 40 may still remain because of the residual magnetism in the first and second rotary members 20, 40, or the residual magnetism and a small electric potential difference. In this case, a non-magnetic member (not shown) may be fixed to the engaging portion 41 for reducing the strength of the attracting force between the first and second rotary members 20, 40 so as not to be attracted each other, to thereby cancel the cruise control operation certainly.

Figure 4:
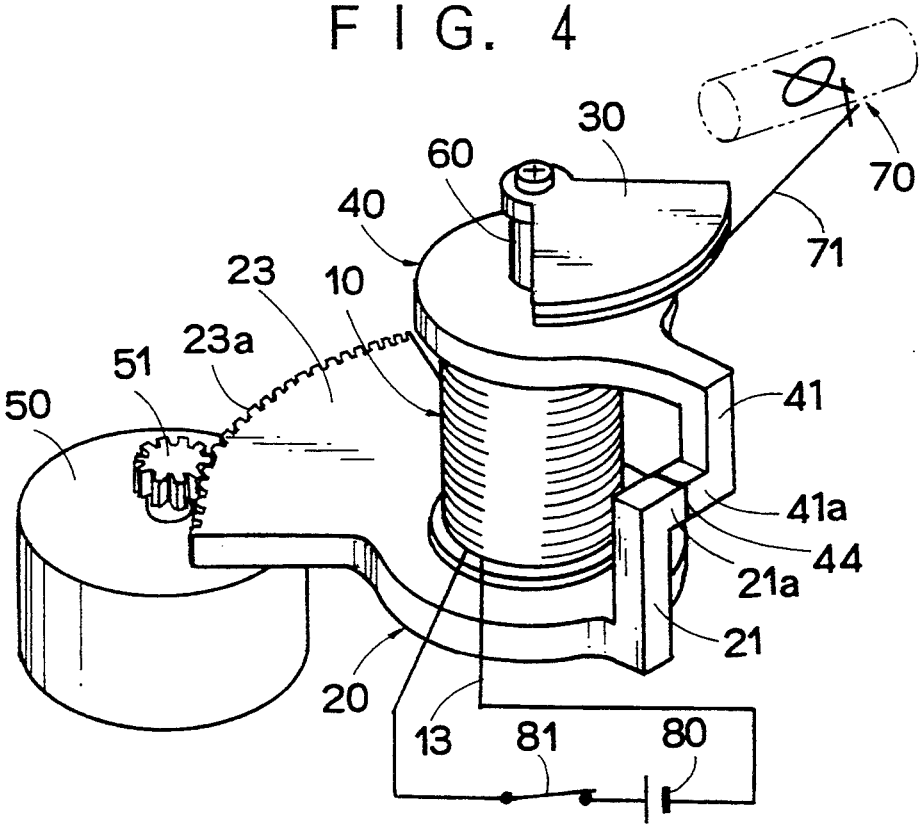
FIG. 4 is a perspective view of the actuator of a second embodiment when a solenoid is excited.
Figure 5:
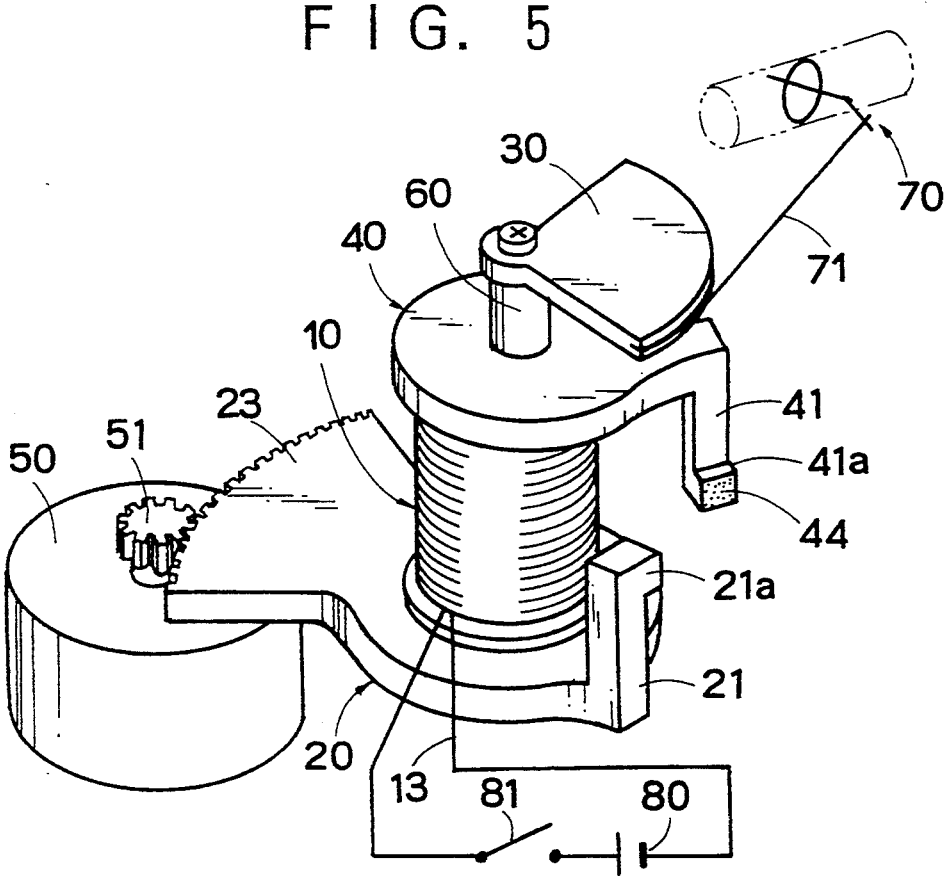
FIG. 5 is a perspective view of the actuator of the second embodiment when the solenoid is not excited.

FIGS.4 and 5 show a second embodiment of the present invention, wherein engaging portions 21, 41 are provided with right angle portions 21*a*, 41*a*, respectively. Each of the right angle portions 21*a*, 41*a* has an end surface perpendicular to the magnetic path formed between the engaging portions 21 and 41. Therefore, the attracting force created between the engaging portions 21 and 41 according to the second embodiment is much stronger than the attracting force created in the first embodiment, provided that the same voltage is applied to the coil 12 in the first and second embodiments. In other words, the same strength of the attracting force can be obtained in the second embodiment as that of the attracting force obtained in the first embodiment with less electric power in the second embodiment than in the first embodiment, so that the second embodiment has a higher efficiency than the first embodiment.

In place of the non-magnetic ring 42 as shown in FIG. 1, a non-magnetic plate 44 may be provided between the end surfaces of the right angle portions 21*a* and 41*a* facing each other in the second embodiment as shown in FIGS. 4 and 5. The thickness of the ring 42 or the plate 44 is determined such that the attracting force retained by the residual magnetism between the first and second rotary members 20, 40 is weakened to the extent that the input gear member and output rotary member can be disconnected.

It should be apparent to one skilled in the art that the above-described embodiments are merely illustrative of but two of the many possible specific embodiments of the present invention. Numerous and various other arrangements can be readily devised by those skilled in the art without departing from the spirit and scope of the invention as defined in the following claims.

What is claimed is:

1. An actuator mounted on a base for rotating a rotary member about a rotational axis thereof, comprising:

a first magnetic rotary member rotatably mounted on said base about said rotational axis, said first magnetic rotary member having a first engaging portion which traces a peripheral locus about said rotational axis;

a second magnetic rotary member rotatably mounted about said rotational axis, and having a second engaging portion engageable with said first engaging portion on the peripheral locus about said rotational axis, said first engaging portion being moved to be engageable with said second engaging portion when said first magnetic rotary member is rotated in one direction relative to said second magnetic rotary member, and said first engaging portion being moved to be away from said second engaging portion when said first magnetic rotary member is rotated in the opposite direction relative to said second magnetic rotary member;

a solenoid concentrically mounted about said rotational axis in stationary relationship with said base, said solenoid exciting said first and second magnetic rotary members to form a magnetic path therewith when said first and second engaging portions engage with each other; and rotating means for rotating said first magnetic rotary member about said rotational axis.

2. An actuator as claimed in claim 1, wherein said solenoid includes a bobbin defining therein a through hole and a coil wound around said bobbin, and wherein said first magnetic rotary member includes a cylindrical body portion which is received in the through hole of said bobbin.

3. An actuator as claimed in claim 2, wherein a rotating shaft is secured to said second magnetic rotary member extending along said rotational axis, and wherein said cylindrical body portion has a central aperture defined therein along a longitudinal axis of said cylindrical body portion, said central aperture receiving said rotating shaft.

4. An actuator as claimed in claim 3, wherein said rotating means includes an output gear rotating around an axis thereof, and wherein said first magnetic rotary member includes a sector wheel meshed with said output gear of said rotating means.

5. An actuator as claimed in claim 1, wherein said solenoid is provided between said first and second magnetic rotary members, and wherein at least a non-magnetic member is provided in said magnetic path.

6. An actuator as claimed in claim 5, wherein said non-magnetic member is provided between said solenoid and said second magnetic rotary member.

7. An actuator as claimed in claim 5, wherein said first and second engaging portions are respectively provided with a right angle portion having an end surface to contact each other when said second engaging portion engages with said first engaging portion.

8. An actuator as claimed in claim 7, wherein said non-magnetic member is provided between said first and second engaging portions.

9. An apparatus mounted on a base in an automotive vehicle for actuating a throttle valve of said vehicle, comprising:

a first magnetic rotary member rotatably mounted on said base about a rotational axis of said rotary member, said first magnetic rotary member having a cylindrical body portion which extends along said rotational axis, and having a first engaging portion which traces a peripheral locus about said rotational axis;

a second magnetic rotary member rotatably mounted about said rotational axis, and having a second engaging portion engageable with said first engaging portion on the peripheral locus about said rotational axis, said first engaging portion being moved to be engageable with said second engaging portion when said first magnetic rotary member is rotated in one direction relative to said second magnetic rotary member, and said first engaging portion being moved to be away from said second engaging portion when said first magnetic rotary member is rotated in the opposite direction relative to said second magnetic rotary member;

a solenoid concentrically mounted about said rotational axis in stationary relationship with said base, said solenoid including a bobbin defining therein a through hole and a coil wound around said bobbin for exciting said first and second magnetic rotary members to form a magnetic path therewith when said first and second engaging portions engage with each other, said cylindrical body portion of said first magnetic rotary member being received in the through hole of said bobbin;

a rotating shaft secured to said second magnetic rotary member extending along said rotational axis, said cylindrical body portion of said first magnetic rotary member having a central aperture defined therein along a longitudinal axis of said cylindrical body portion, said central aperture receiving said rotating shaft;

rotating means for rotating said first magnetic rotary member about said rotating shaft; and an output rotary member connected to said rotating shaft for activating said throttle valve in response to the rotation of said second magnetic rotary member when said first and second rotary member are engaged with each other to rotate together about said rotating shaft.

10. An apparatus as defined in claim 9, wherein said solenoid is provided between said first and second magnetic rotary members, and wherein at least a non-magnetic member is provided in said magnetic path.

11. An apparatus as defined in claim 10, wherein said first and second engaging portions are respectively provided with a right angle portion having an end surface to contact each other when said second engaging portion engages with said first engaging portion.

* * * * *